US006015261A

United States Patent [19]

Barone

[11] Patent Number: 6,015,261

[45] Date of Patent: Jan. 18, 2000

[54] CEILING FAN BLADE COVER

[76] Inventor: Connie Barone, 1453 Carlos Way, Upland, Calif. 91786

[21] Appl. No.: 09/088,035

[22] Filed: Jun. 2, 1998

[51] Int. Cl.[7] ..... F04D 29/00; F04D 29/70

[52] U.S. Cl. ..... 416/62; 416/5; 416/146 R

[58] Field of Search ..... 416/62, 5, 146 R

[56] References Cited

U.S. PATENT DOCUMENTS

| | | | |
|---|---|---|---|
| 4,676,721 | 6/1987 | Hardee | 416/146 R |
| 5,281,093 | 1/1994 | Sedlak | 416/62 |
| 5,516,264 | 5/1996 | Anetrini | 416/62 |
| 5,564,900 | 10/1996 | McAuley | 416/62 |
| 5,591,005 | 1/1997 | McCready | 416/62 |

*Primary Examiner*—Edward K. Look
*Assistant Examiner*—Rhonda Barton

[57] ABSTRACT

A removable and replaceable cover for a ceiling fan blade is disclosed. The cover includes a first material which covers the bottom surface of the fan blade and wraps around the outer edges of the fan blade and a second elastic material which joins the ends of the first material and is positioned adjacent the top surface of the fan blade. One or more straps are attached to the open end of the cover and wrap around the arm which attaches the blade to the fan motor. A hook-and-loop fastener is provided on the end of the strap and a mating attachment is provided on the first material.

5 Claims, 2 Drawing Sheets

CEILING FAN BLADE COVER

TECHNICAL FIELD

The present invention relates, in general, to ceiling fans and, more particularly, to replaceable covers for the blades comprising a ceiling fan.

BACKGROUND ART

Ceiling fans have become very popular for use in residential and commercial applications. One of the inherent problems associated with ceiling fans is that a substantial amount of dirt and dust accumulates on the top surface of the fan blades. In addition, if the fans are exposed to an aggressive environment, the surfaces of the blades can deteriorate over time. In order to clean the fan blades, a person usually has to utilize a step stool or ladder to reach the top surface of the blades which have a tendency to move during the cleaning process. Alternatively, the person could remove each of the blades for cleaning, however, the blades would then have to be reinstalled which might create an "unbalanced" condition when the fan is subsequently operated. The blades are typically balanced with weights during the installation process, and thus, the blades and their associated weights would have to be reinstalled on the same arms in order to prevent the creation of an "unbalanced" condition. In any event, cleaning the top surface of the blades is a cumbersome process and can be hazardous considering the fact that a person is "balancing" on a step stool or ladder when cleaning the blades and the blades have a tendency to move during the cleaning process.

Because of the foregoing problems associated with cleaning the top surface of ceiling fan blades, it has become desirable to develop a cover for the fan blades which can be easily removed, cleaned and reinstalled on the blades.

SUMMARY OF THE INVENTION

The present invention solves the problems associated with cleaning ceiling fan blades by providing a removable and replaceable cover for each of the fan blades. The cover has a substantially tubular configuration which tapers inwardly towards the point of attachment of the blade to the rotatable arm of the fan. The cover is formed from a fabric which is joined together by an elastic material, such as Spandex or the like. The fabric portion of the cover is large enough to "cover" the bottom surface of the fan blade and wrap around its outer edges permitting its ends to be joined together by the elastic material which is positioned adjacent the top surface of the fan blade. The end of the cover adjacent the rotatable arm of the fan is provided with substantially parallel, longitudinally extending straps having a hook-and-loop type attachment means adjacent their ends. The mating hook-and-loop type fastener is provided on the fabric portion of the cover that is adjacent the top surface of the fan blade. The straps wrap around the associated arm for the fan blade allowing the hook-and-loop type fastening arrangement to be engaged. Utilization of a hook-and-loop type fastening arrangement and the elastic material for a portion of the cover ensures that the cover is securely attached to the fan blade.

DESCRIPTION OF THE PREFERRED EMBODIMENT

Figure 1:
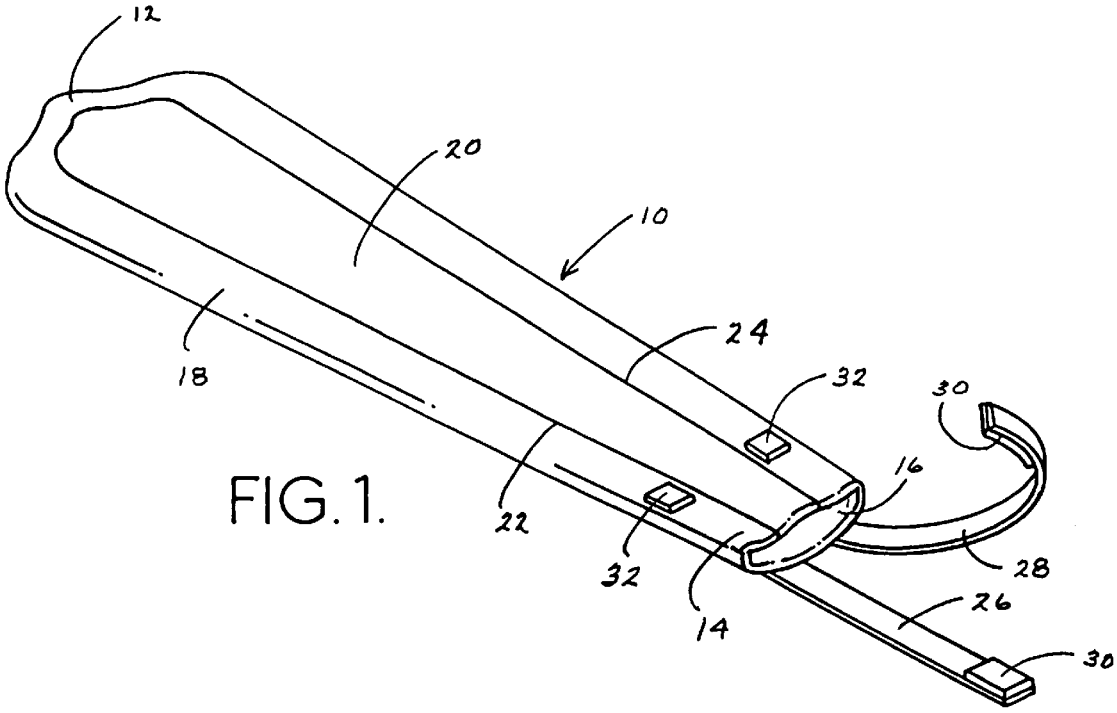
FIG. 1 is a perspective view of the present invention.
Figure 2:
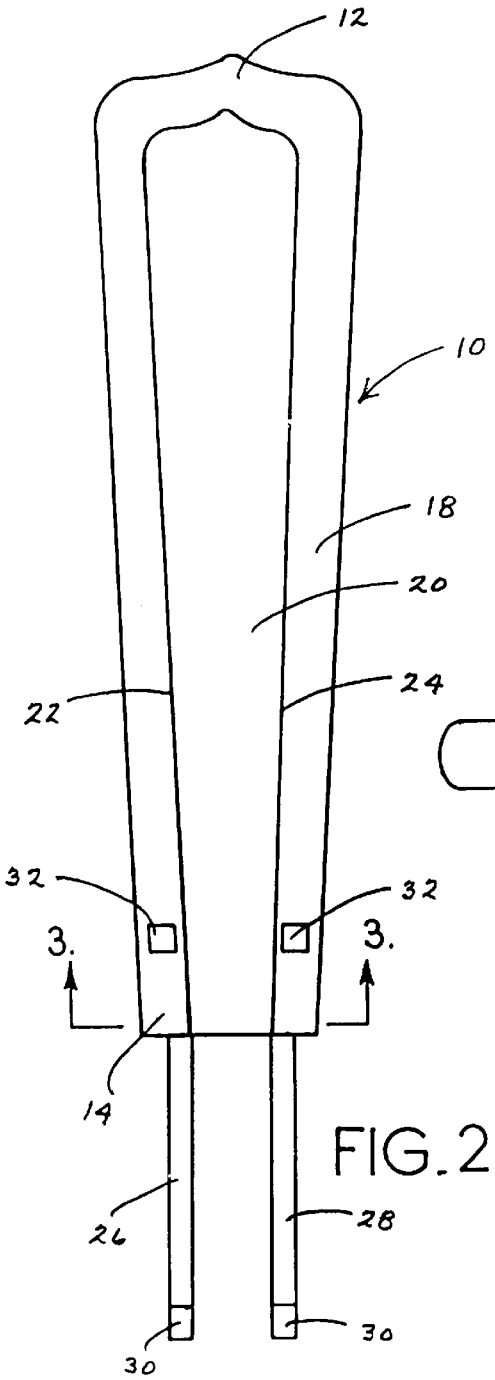
FIG. 2 is a top plan view of the present invention.
Figure 3:
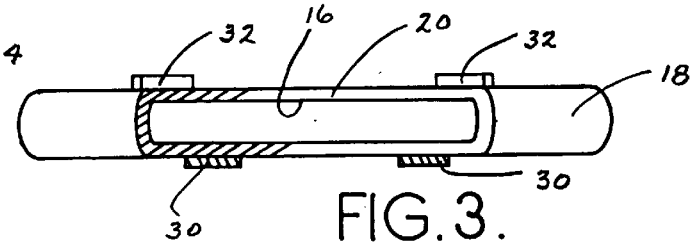
FIG. 3 is a cross-sectional view of the present invention taken across section indicating lines 3—3 in FIG. 2.

Referring now to the drawings where the illustrations are for the purpose of describing the preferred embodiment of the present invention and are not intended to limit the invention described herein, FIG. 1 is a perspective view of the fan blade cover 10 of the present invention. The fan blade cover 10 has a configuration which is substantially complementary to that of a ceiling fan blade and is generally tubular in shape and tapered so that its outer end 12, which covers the outer end of a ceiling fan blade, is larger than its inner end 14 which is positioned adjacent to the arm that attaches the fan blade to the fan motor. The cover 10 is closed at its outer end 12 and has an opening 16 at its inner end 14. The cover 10 is comprised of a first material 18, such as a fabric or the like, and a second elastic material 20, such as Spandex or the like, which joins together the edges 22 and 24 of the first material 18. First material 18 is sufficiently wide so as to cover the bottom surface of the fan blade and wrap around its outer edges for joining to the second material 20 along edges 22 and 24 of first material 18. When the cover 10 is installed on a fan blade, the first material 18 is oriented so as to be adjacent the bottom surface of the fan blade and the second material 20 is oriented so as to be adjacent the top surface of the fan blade. Straps 26, 28 are positioned adjacent opening 16 in cover 10 and are oriented so as to be substantially parallel to the longitudinal axis of cover 10. The end of each strap 26, 28 is provided with a hook-and-loop fastener 30 which has its mating fastener 32 provided on first material 18 adjacent edges 22, 24 thereof as shown in FIGS. 2 and 3.

In order to install the cover 10 on a fan blade, (not shown), the outer end of the fan blade in inserted into opening 16 in the inner end 14 of cover 10 and cover 10 is received over the fan blade such that the second material 20 is adjacent the top surface of the fan blade and first material 18 is adjacent the bottom surface of the fan blade. When the cover 10 is fully received on the fan blade, the opening 16 of cover 10 is adjacent the arm which connects the fan blade to the fan motor. The straps 26, 28 are then passed over the arm which attaches the fan blade to the fan motor and the hook-and-loop fastener 30 engages it mating fastener 32 which is positioned adjacent the top surface of the fan blade. The straps 26, 28 can be crossed and engage oppositely disposed fasteners 32 so as to attach the cover 10 to the fan blade. The utilization of the hook-and-loop fasteners 30 and 32, along with the utilization of elastic material for a second material 20, ensures that the cover 10 firmly engages the entire surface of the fan blade and is firmly attached thereto and to the arm which attaches the fan blade to the fan motor.

The present invention provides a number of benefits to the user. For example, the present invention ensures that the top surface of the fan blades remain clean, thus eliminating the need to manually clean same either by utilizing a step stool or ladder or by removing the blade from its associated arm, cleaning the blade and then reinstalling same. The removal and reattachment of the fan blade to its associated arm could possibly result in the ceiling fan becoming "unbalanced". In addition, the utilization of the present invention increases the life of the fan blades and, thus, the life of the ceiling fan since the fan blades are not exposed to atmospheric conditions. Furthermore, the utilization of the present invention provides decorative options permitting the co-ordination of the color of the fan blades to room decor. Alternatively, the fan blade covers may have a pattern thereon so as to co-ordinate with wall colors or wall covering, window coverings, bed spread patterns, carpeting, etc. Lastly, through the utilization of patterns on the fan blade covers, decorative options directed to seasons of the year or specific holidays within the year are possible.

Certain modifications and improvements will occur to those skilled in the art upon reading the foregoing. It should be understood that all such modifications and improvements have been deleted herein for the sake of conciseness and readability, but are properly within the scope of the following claims.

I claim:

1. A cover for a fan blade comprising a substantially tubular sleeve formed from a first material having substantially oppositely disposed ends and a second material having elastic properties, said second material substantially joining together said substantially oppositely disposed ends of said first material, said substantially tubular sleeve having a first end which is substantially closed and an oppositely disposed second end which is open and having a tapered configuration from said first end to said second end resulting in said first end being larger than said second end and means for attaching said cover to a fan blade.

2. The cover as defined in claim 1 wherein the width of said first material is greater than the width of said second material.

3. The cover as defined in claim 1 wherein said attaching means comprises at least one strap positioned adjacent said second end of said tubular sleeve and having fastening means attached to the end thereof.

4. The cover as defined in claim 3 wherein said at least one strap is substantially parallel to the longitudinal axis of said tubular sleeve.

5. The cover as defined in claim 3 wherein said attaching means comprises a hook-and-loop fastening arrangement.

* * * * *